United States Patent [19]

Piolat

[11] Patent Number: 4,913,783

[45] Date of Patent: Apr. 3, 1990

[54] PROCESS FOR THE MANUFACTURE OF A PERFORATED NICKEL FRAME BY ELECTROFORMING

[75] Inventor: Armand Piolat, Saint Georges d'Esperanche, France

[73] Assignee: Piolat Industrie, St. Georges d'Esperanche, France

[21] Appl. No.: 347,144

[22] Filed: May 1, 1989

[30] Foreign Application Priority Data

May 2, 1988 [FR] France ..... 88 06428

[51] Int. Cl.[4] ..... C25D 1/08

[52] U.S. Cl. ..... 204/11

[58] Field of Search ..... 204/11

[56] References Cited

U.S. PATENT DOCUMENTS

| | | | |
|---|---|---|---|
| 2,226,384 | 12/1940 | Norris | 204/11 |
| 4,397,715 | 8/1983 | Mohan et al. | 204/11 |
| 4,430,170 | 2/1984 | Stern | 204/39 |
| 4,430,171 | 2/1984 | Lemke et al. | 204/44.5 |

FOREIGN PATENT DOCUMENTS

| | | |
|---|---|---|
| 0038104 | 3/1985 | European Pat. Off. . |
| 0049022 | 8/1985 | European Pat. Off. . |
| 0079642 | 2/1988 | European Pat. Off. . |
| 2051130 | 1/1981 | United Kingdom . |

*Primary Examiner*—T. M. Tufariello

*Attorney, Agent, or Firm*—Oliff & Berridge

[57] ABSTRACT

The present invention relates to the production by electroforming of perforated frames used especially to form flat or cylindrical printing frames. According to the invention, the procedure is in two stages, with two separate electrochemical baths, the second bath comprising a pyridinium compound of general formula:

in which:

R is an optionally substituted alkyl chain,

R' is a hydrogen atom or a substituent group in any position relative to the nitrogen atom of the pyridinium nucleus.

9 Claims, 2 Drawing Sheets

PROCESS FOR THE MANUFACTURE OF A PERFORATED NICKEL FRAME BY ELECTROFORMING

Figure 1:
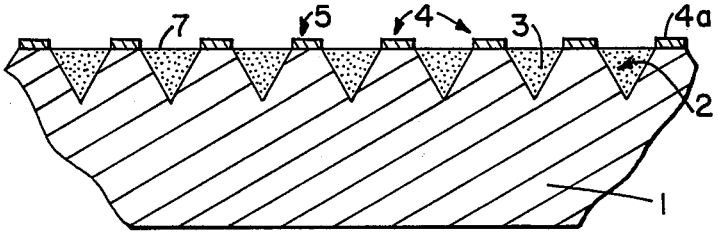

The present invention relates to a process for the manufacture of a perforated nickel frame by electroforming.

Perforated frames of this kind are employed in particular as printing frames, be they for so-called "flat frame" prints or so-called "rotary frame" prints.

More precisely, the invention relates to a process of manufacture, such as described and proposed by the patent US-A-2,226,384, the content of which is incorporated in the present description.

According to this process, the starting point is a support mandrel made of solid copper, of stainless steel or of coppered steel. Alveoli whose shape and dimensions correspond to the meshes of the perforated frame to be obtained are arranged at the surface of the mandrel by various engraving processes, such as chemical etching, engraving with an embossing tool or electronic engraving.

The hollow opening of the alveoli is filled with a nonconductive resin leaving uncovered the edge or ridge of the same alveoli, which remains conductive.

Then, according to a first stage, and in a first electrolytic bath, a first deposit of nickel is produced on the support mandrel, for a limited time, so as to obtain a nickel skeleton whose perforations correspond substantially to the original alveoli of the mandrel. The duration of this first stage is therefore chosen to limit the growth of the nickel deposit from the ridges of the alveoli, preferably upwards. At the end of this first stage the skeleton is separated from the mandrel, for example by simple cooling causing a differential expansion and hence a release of the skeleton in relation to the mandrel.

According to a second stage, and in a second electrolytic bath, a second deposit of nickel is produced on the skeleton. This additional input of metal encloses and reinforces all the nickel skeleton strands, to obtain the final perforated frame.

One of the problems presented by this process of manufacture, in particular when it is employed to obtain perforated frames with unit meshes of very small dimensions, relates to the blocking of the perforations in the skeleton by nickel during the second electrolysis stage. In addition to the deterioration or modification of the shape and of the original dimensions of the perforations in the skeleton, this additional nickel deposit reduces the flow cross-section of each unit mesh of the final perforated frame. Such a reduction in the free cross-section of each unit mesh consequently reduces the quantity of printing fluid which can flow through the perforated frame when the latter is employed as a printing frame.

The user of the usual and conventional additives in electrochemistry, namely the use of products described and referred to in the literature as "primary brighteners" and "secondary brighteners" makes it possible, to a large extent, to observe the initial shape and dimensions of the perforations in the skeleton, as established on pages 52–53 of the Guide to Nickel Electroforming, published by International Nickel (INCO) in 1975. This is explained by the fact that the expected levelling effect cannot take place in the hollow or empty parts corresponding to the perforations in the skeleton, and is therefore consequently displaced in height, on both sides of the nickel strands of the same skeleton.

Be that as it may, this conformity to the original perforations in the skeleton leads to a relatively large decrease in the flow cross-section, by "homothetic" inward progression of the nickel deposit, from the edge of each perforation in the skeleton.

The subject matter of the present invention is a process such as described above enabling the skeleton resulting from the first stage to be reinforced while at the same time observing the essentiality of the dimensions of the perforations in the said skeleton and while limiting the decrease in the free cross-section of the meshes of the perforated frame obtained.

Another subject of the present invention is an electronic process which remains simple in its use, and in particular does not resort to sophisticated technological solutions such as a pulsed feed current.

According to the present invention it has been found that this effect could be obtained by employing at least in the second bath a pyridinium compound corresponding to the general formula:

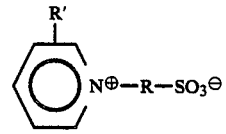

in which:

R is a saturated alkyl chain containing at least one carbon atom and optionally substituted R' is a hydrogen atom or a substituent group in any position relative to the nitrogen atom of the pyridinium nucleus.

Preferably, but not exclusively:

R is an alkyl chain substituted by at least one group containing no double or triple bond with a carbon atom and/or R' is a substituent group containing no bond with a carbon atom.

A double or triple bond with a carbon atom is intended to mean bonds of the type:

C=C, C≡C, C=N, C≡N

By way of example of the pyridinium compounds which can be employed according to the invention there may be mentioned the following sulfopropyl compounds, identified according to the CAS nomenclature:

4-methyl-1-(3-sulfopropyl)pyridinium
4-benzyl-1-(3-sulfopropyl)pyridinium
1-(2-hydroxy-3-sulfopropyl)pyridinium
3-methyl-1-(3-sulfopropyl)pyridinium
1-(3-sulfopropyl)pyridinium
2-methyl-1-(3-sulfopropyl)pyridinium According to a preferred embodiment of the invention, the pyridinium compound is employed in the second electrolytic bath, together with a compound listed in the relevant literature as a voltage reducer. A compound of this kind may be a sulfonimide, such as saccharin, a sulfonamide, para-toluenesulfonamide, sodium meta-benzenedisulfonate,sodium 1,3,6-naphthalene-trisulfonate, an arylsulfonic acid, and the like.

The pyridinium compound is employed in a proportion of 60 to 250 g per 10,000 A/h, preferably at the same time as a voltage reducer such as described above, in proportions of 10 to 500 g per 10,000 A/h.

Figure 2:
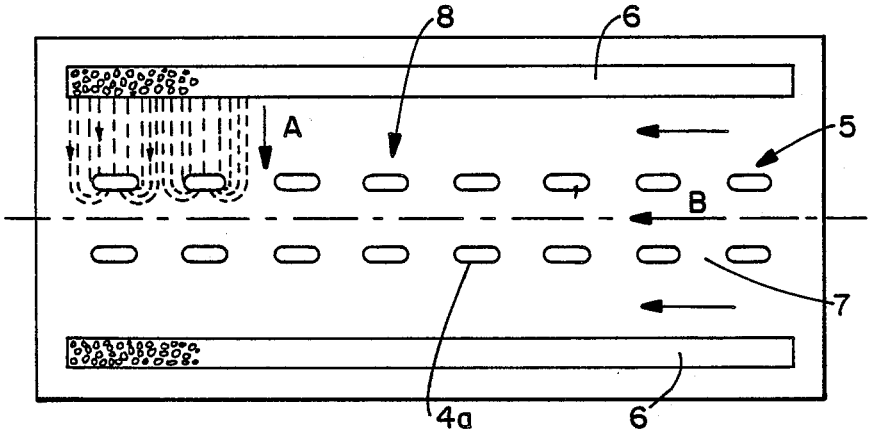
Figure 3:
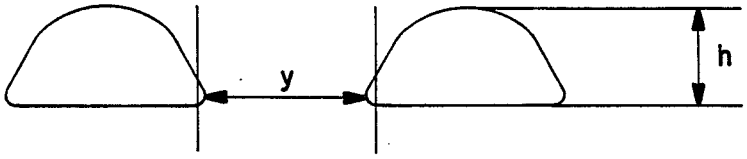
Figure 4:
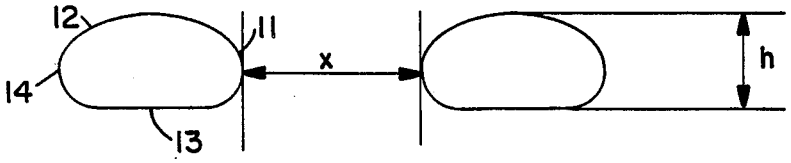
Figure 5:
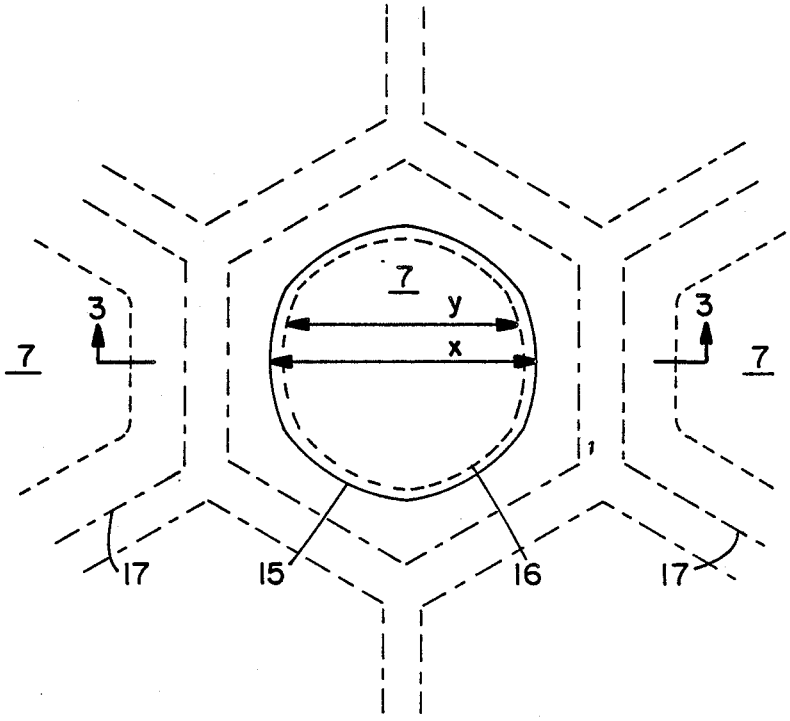

The present invention is now described with reference to the attached drawings, in which:

FIG. 1 shows in cross-section the nickel skeleton obtained at the end of the first stage of electrolysis, in position on the support mandrel, FIG. 2 shows a top view of the electrolytic cell ensuring during the second stage the deposition of nickel on the skeleton obtained at the end of the first stage, FIG. 3 is a highly enlarged detailed view, in section along the line 3—3 of FIG. 5, of the mesh of a perforated frame obtained with a conventional second electrochemical bath, during the second stage, that is to say with a bath containing compounds listed as primary and secondary brighteners in the standard literature, FIG. 4 is a detailed view similar to FIG. 3, of the mesh obtained with a second electrochemical bath according to the invention, FIG. 5 is a top view, from the inner side to the perforated cylinder, on an enlarged scale, of the mesh obtained from the same skeleton with a conventional second electrochemical bath (represented by the broken lines) and with a second electrochemical bath according to the invention (represented by solid lines).

The electrochemical process according to the invention is generally in accordance with the process described in patent US-A-2,226,384, so that there appears to be no need to describe this process in detail.

According to the first stage of the process, use is made in accordance with FIG. 1, of a matrix or support mandrel 1 comprising alveoli 2 whose opening has been closed with a nonconductive substance such as a resin 3. Correspondingly the edge or ridge 4 of the same alveoli remains electrically conductive. At the end of the first stage of the process, and with a first conventional electrolytic bath, a nickel skeleton 5 is obtained, comprising perforations 7 corresponding substantially to the openings of the original alveoli 2. This approximate correspondence is obtained by a suitable limitation of the duration of the first electrochemical stage. At the end of the latter, the skeleton 5 is removed from the support mandrel 1.

According to the second stage of the process, and in accordance with FIG. 2, the skeleton 5 is immersed in second nickel electrolytic bath 8, to which a pyridinium compound according to the invention has been added. The bath is preferably circulated in the direction of the arrows B, that is to say parallel to the anode 6, and hence to a generatrix of the skeleton 5 in a cylindrical shape in the present case. The circulation velocity of the bath is between 5 and 10 cm/second; correspondingly, the arrows A show the direction of the lines of current from the anode 6 to the cathode 5. These lines are perpendicular to the cathode skeleton and to the direction of travel of the electrolytic bath. The method of circulation of the second electrochemical bath chosen according to the invention brings various advantages. On the one hand, the ion exchange between the anode(s) (6) and the cathode consisting of the nickel skeleton (5) can increase considerably, increasing the current intensity. On the other hand, all the impurities capable of separating from the anodes or from the cathode skeleton are entrained out of the latter.

During the second stage, nickel is progressively deposited around the strands 4*a* of the skeleton 5, flowing inside the perforations 7 and travelling along the inner and outer walls of the skeleton 5.

By virtue of the action of the pyridinium compound according to the invention, introduced into the second electrolytic bath, the perforated frame obtained exhibits a highly characteristic mesh profile, shown in FIG. 4 insofar as a cross-section of the nickel strands along the line 3—3 of FIG. 5 is concerned, and in FIG. 5, as a solid line, insofar as the flat shape of the mesh is concerned, from the inner side of the perforated cylindrical frame.

In accordance with FIG. 4, a rounding-off of the nickel deposit is surprisingly observed, not only outside the cylinder but also inside, in contrast to the flattening observed on the inner side, according to FIG. 3, in the case of a deposit with a bath to which a primary brightener and a secondary brightener, both conventional, have been added. According to the invention, nickel strands are therefore obtained, both their upper part and their lower part exhibiting bulges 12 and 13 oriented in the direction of the height, these bulges being connected to each other by the rounded parts 11 and 14.

With reference to FIG. 5, and assuming that the support matrix 1 comprises alveoli which have a hexagonal flat shape, in order to obtain a perforated frame with a hexagonal mesh, it is found that the perforations obtained according to the invention exhibit, in fact, this flat shape of general hexagonal appearance, but with a profile which is rounded off at all points, inscribing, in a way, the hexagonal profile. This is shown by the continuous line 15 delimiting each perforation in the frame, in comparison with the broken line 16 corresponding to the flat shape finally obtained with a second electrochemical bath to which a primary brightener and a secondary brightener have been added in a conventional manner, while all the other electrochemical parameters remain otherwise the same. In FIG. 5, the broken line 17, in its turn, shows the flat shape of the openings in the skeleton resulting from the first electrolysis stage, before an electrochemical treatment according to the second stage of the process.

Summing up, on comparing FIGS. 3 and 4, on the one hand, and the dashed 16 and solid 15 lines according to FIG. 5, it is found that in the case of a substantially equal height of nickel h according to the invention and according to the prior art, the addition of the pyridinium compound makes it possible to obtain a perforation opening (x) which is appreciably superior to the perforation opening (y) obtained according to the prior art, that is to say with an electrolytic bath made up in a conventional manner. For the same single size of perforation in the final frame, expressed, for example, as a mesh, this results, in favour of the invention, in an advantage which is not insignificant, with regard to the value of the flow cross-section of each unit mesh.

Two examples of application of the second electrochemical bath according to the invention are described below.

The first example of a nickel bath employed is of the nickel salts type and contains:

300 g per liter of nickel sulfate
50 g per liter of nickel chloride
50 g per liter of boric acid
100 g of 1-(3-sulfopropyl)pyridinium per 10,000 A/h
250 g of sodium naphthalenetrisulfonate per 10,000 A/h.

The electrolysis of the second bath is carried out in a conventional manner, with the bath circulating, furthermore, parallel to the anode and to the cathode cylinder.

A second example of a bath in accordance with the invention contains:

250 g per liter of nickel sulfate 40 g per liter of nickel chloride
45 g per liter of boric acid
150 g per liter of 1-(2-hydroxy-3-sulfopropyl)-pyridinium per 10,000 A/h
100 g of sodium saccharinate per 10,000 A/h
40 $cm^3$ of wetting agent per 10,000 A/h.

A microscopic examination of the perforated frames obtained with these two baths makes it possible to ascertain that the nickel deposit produced on the base skeleton exhibits the original appearance described above, from a support mandrel comprising alveoli of flat hexagonal shape.

The process according to the invention is suitable for depositing nickel from a nickel anode containing sulfur (S nickel). It appears preferable, however, to employ nickel without sulfur to limit the internal stresses.

As already stated, the process according to the invention applies equally well to the production of flat perforated frames and of cylindrical frames.

I claim:

1. A process for the manufacture by electroforming of a perforated nickel frame, according to which the operation is carried out in at least two stages:

(a) according to a first stage, and in a first electrolytic bath, a first deposit of nickel is produced on an engraved support mandrel comprising alveoli whose opening is closed by a nonconductive substance, and whose edge or ridge is conductive, and a nickel skeleton is separated from the mandrel, its perforations corresponding substantially to the alveoli of the said mandrel, (b) according to a second stage, and in a second electrolytic bath, a second deposit of nickel is produced on the skeleton, characterized in that at least the second bath has added to it a pyridinium compound of formula:

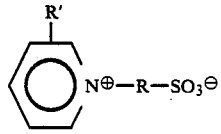

in which:

R is a saturated alkyl chain containing at least one carbon atom and optionally substituted, R' is a hydrogen atom or a substituent group in any position relative to the nitrogen atom of the pyridinium nucleus.

2. A process according to claim 1, characterized in that R is an alkyl chain substituted by at least one group containing no double or triple bond with a carbon atom.

3. A process according to claim 1, characterized in that R' is a substituent group containing no double or triple bond with a carbon atom.

4. A process according to claim 1, characterized in that the pyridinium compound is sulfopropylated and R is an alkyl chain containing three carbon atoms.

5. A process according to claim 2, characterized in that the alkyl chain is substituted by a hydroxyl group in position 2 relative to the pyridinium nucleus.

6. A process according to claim 3, characterized in that the pyridinium nucleus is substituted by at least one group chosen from the following groups, namely methyl and benzyl.

7. A process according to claim 1, characterized in that the pyridinium compound is employed in the second bath in a proportion of 60 to 250 g per 10,000 A/h.

8. A process according to claim 1, characterized in that the second bath is circulated parallel to the anode at a velocity of between 5 and 20 cm/second.

9. A process according to claim 1, characterized in that the pyridinium compound is employed in the second bath with a voltage-reducer compound.

* * * * *